US005961364A

United States Patent [19]

Bach et al.

[11] Patent Number: 5,961,364

[45] Date of Patent: Oct. 5, 1999

[54] BUILDING SET FOR A TOY BUILDING

[75] Inventors: Erik Bach; Kaj Svejstrup Mikkelsen, both of Billund; Carsten Peter Michaelsen, Vejle; Philip Marshall Kushner, Greve, all of Denmark

[73] Assignee: INTERLEGO AG, Baar, Switzerland

[21] Appl. No.: 08/752,537

[22] Filed: Nov. 20, 1996

Related U.S. Application Data

[60] Provisional application No. 60/006,972, Nov. 20, 1995.

[30] Foreign Application Priority Data

Nov. 20, 1995 [DK] Denmark ..... 1301/95

[51] Int. Cl.[6] ..... A63H 33/06; A63H 3/52

[52] U.S. Cl. ..... 446/110; 446/118; 446/111; 446/476; 446/482

[58] Field of Search ..... 446/105, 108, 446/110, 117, 118, 124, 125, 482, 109, 111, 476; 434/80

[56] References Cited

U.S. PATENT DOCUMENTS

| | | | |
|---|---|---|---|
| 2,988,844 | 6/1961 | Frimberger | 446/125 |
| 3,284,946 | 11/1966 | Christiansen | 446/105 |
| 3,594,940 | 7/1971 | Yonezawa | 446/118 |
| 3,890,738 | 6/1975 | Bassani | 446/111 |
| 4,164,091 | 8/1979 | Lin | 446/124 |
| 4,270,303 | 6/1981 | Xanthopoulos et al. | 446/110 |
| 4,571,200 | 2/1986 | Serna | 446/111 |
| 5,435,769 | 7/1995 | Bertrand | 446/482 |

FOREIGN PATENT DOCUMENTS

| | | | |
|---|---|---|---|
| 133178 | 5/1993 | Australia | 446/110 |
| 1180316 | 6/1959 | France | 446/124 |
| 2336956 | 1/1976 | France | 446/124 |
| 1442602 | 7/1976 | United Kingdom | 446/118 |
| 8905180 | 6/1989 | WIPO | 446/476 |

*Primary Examiner*—Robert A. Hafer
*Assistant Examiner*—Laura Fossum
*Attorney, Agent, or Firm*—Kane, Dalsimer, Sullivan, Kurucz, Levy, Eisele and Richard, LLP

[57] ABSTRACT

A building set for a toy building comprising a number of building module frames (1,1*a*,1*b*,2) and a plurality of fittings (10,17,18), and wherein each of the building module frames (1,1*a*,1*b*,2) comprises a bottom plate (3,4,19) with a superstructure that defines the walls and ceiling of the building module frame (1,1*a*,1*b*,2), and wherein each bottom plate (3,4,19) is provided with coupling means (12) for interconnecting adjoining building module frames (1,1*a*,1*b*,2). By arranging the coupling means (12) on the top surface of the bottom plate (3,4,19) and by arranging the coupling means (12) to be releasably interconnected with complementary coupling means (11) on the underside of the fittings (10,17,18), a stable and secure coupling is obtained that possesses much holding force without much force being required to interconnect the building module frames.

10 Claims, 5 Drawing Sheets

BUILDING SET FOR A TOY BUILDING

This application claims benefit of Provisional Appln. Ser. No. 60/006,972 filed Nov. 20, 1995.

The present invention relates to a building set for a toy building and comprising a plurality of building module frames and a number of fittings, and wherein the building module frames comprise a bottom plate with a superstructure that defines the walls and ceiling of the building module frame, and wherein the bottom plate is provided with coupling means for coupling engagement of building module frames next to each other.

Such building sets have become available in recent years in a variety of embodiments where they are particular suitable for doll's houses which thus distinguish themselves relative to conventional inseparably framed. doll's houses in that they provide the option of rearranging the individual rooms of the doll's house relative to each other.

However, the option of rearranging the individual rooms in the doll's house presents a problem as a doll's house constructed from a plurality of adjoining building module frames cannot readily be moved as a coherent unit.

However, the prior art doll's houses solve this problem as described above by featuring a bottom plate which is provided with coupling means for interconnecting two or more building module frames next to each other. In the known doll's houses these coupling means consist of complementary friction- or snap-couplings arranged laterally or the bottom plate in the building module frame.

Assembly of these prior art building module frames is effected by sideways pushing of the building module frames towards each other whereby the complementary coupling means on the bottom plate engage with each other The mutual holding force between the individual building module frames is hereby limited by the intention that a child shall be able to interconnect and disconnect the individual building module frames in order to put the advantages associated with the modular construction of the doll's house to practical use.

In the light of this, it is the object of the present invention to provide a building set of the kind described in the introductory part of claim 1, which building set enables a considerably improved holding force between two interconnected building module frames without presupposing the use of much force to interconnect the building module frames.

This is obtained with the invention as featured in claim 1, since the coupling means are hereby interconnected perpendicularly to the top surface of the bottom plate. This allows the frictional force to be overcome to interconnect the individual building module frames to be comparatively small while simultaneously providing a relatively strong holding force between the building module frames due to the holding force between the building module frames which consist of an essentially geometrical locking resulting from the design of the coupling means.

This increased holding force is also obtained without the use of elements provided exclusively for interconnecting purposes, as the fittings comprised by the building set may be used for other purposes during play.

If two building module frames are interconnected and lifted at opposite sides, a pressure will be applied at the upper edges of the building module frames, depending on the height of the superstructure, whereby these edges are urged towards each other, and a corresponding pull in the fittings which interconnect the bottom plates transversally of the coupling direction will follow. The momentum load between the fittings and the bottom plate is hereby reduced proportionally with the height of the building module frame and replaced by a pull as described above.

Claim 2 features a particularly convenient embodiment where the superstructure of the building module frame is releasably secured to the bottom plate by means of coupling means intended therefor and arranged on the bottom plate as well as on the superstructure, and where the holding force between the bottom plate and the superstructure exceeds the frictional force between the bottom plate and the fittings. This allows the building module frame to be separated from the bottom plate whereby the requirements to packaging dimensions are reduced.

The increased holding force between the superstructure and the bottom plate further ensures that the only way of separating the superstructure from bottom plate is by applying a force which exceeds the frictional force between the fittings and the bottom plate.

In accordance with claim 3 the building set may moreover comprise wall elements with coupling means on the underside for coupling of the wall elements onto the bottom plate. Hereby the coupling means on the top surface of the bottom plate acquire the further function of securing the releasable wall elements while also allowing the wall elements to be used for interconnecting the building module frames.

In accordance with claim 4, the bottom plate may be provided with coupling means along its entire periphery, or better yet across its entire surface whereby it becomes possible to arrange the building module frames in many different positions relative to each other while simultaneously allowing the positioning of the fittings on several locations on the bottom plate where the fittings do not necessary interconnect the building module frames but are secured in a stable manner onto the bottom plate.

Where the coupling elements comprise coupling studs that extend from the bottom plate in accordance with claim 5, these coupling studs may be designed similarly to the coupling studs in known building systems with building blocks which may be used for the construction of walls, furniture or the like on the bottom plate.

Moreover, the bottom plate may be provided with coupling means on the underside, which may be interconnected with separate coupling elements in accordance with claim 6 and which allow further increased holding force between individual building module frames, since the bottom plates may hereby be interconnected at the underside as well as at their top surface.

The design of the bottom plate with support elements in accordance with claim 7 serves to ensure that building modules arranged next to each other will always have the same height above the support whether they are interconnected by a separate coupling element or not.

Claim 8 features a particularly convenient embodiment of these support elements in the form of flanges whereby a stable support is ensured.

The features according to claim 9 provide in particular for stable stacking of building module frames in a mutually displaced manner.

Claim 10 features a further preferred embodiment of the invention where the superstructure may also be coupled in such a manner that the holding force between interconnected building module frames is further increased.

According to a further preferred embodiment, the couplings on the top surface of the superstructure may also be provided for interconnecting with the coupling means on the underside of the bottom plate whereby they may be used for interconnecting building module frames on top of each other.

A preferred embodiment will be described in the following with reference to the drawings, wherein.

Figure 1:
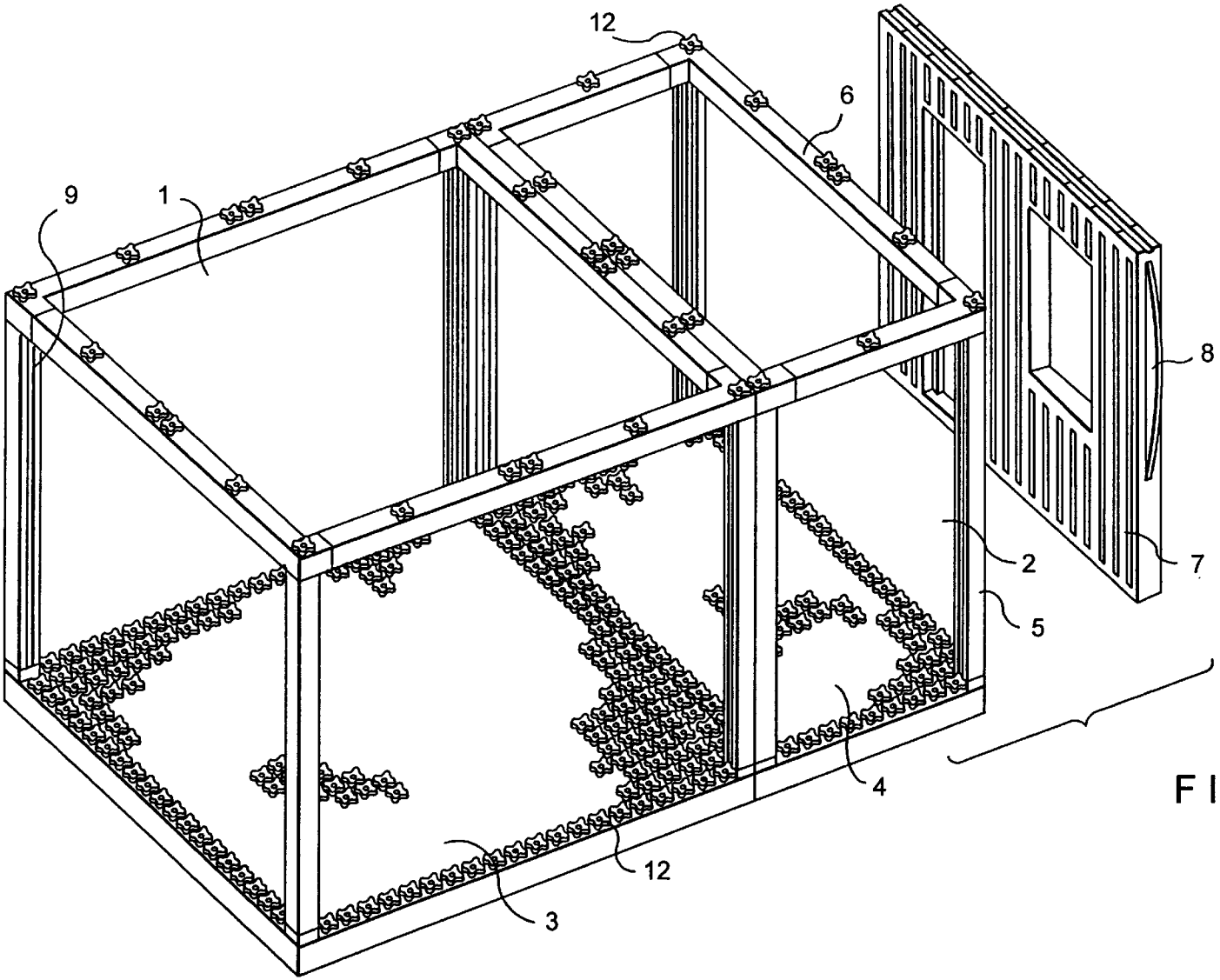
FIG. 1 is a perspective view of two building module frames according to the invention with accompanying fittings and wall element.

Thus FIG. 1 illustrates two building module frames 1,2 according to the invention where each building module frame 1,2 consists of a bottom plate 3,4 on which a grating structure has been erected consisting of columns 5 and girders 6 According to the invention the two building module frames are provided with coupling studs 12 on the bottom plate 3,4 and on the top surface of the girders 6.

As shown in FIG. 1, the building module frame 1 has a square ground plan and the building module frame 2 in FIG. 1 has a rectangular ground plan with a lateral length corresponding to the lateral length of the square building module frame 1, and the other lateral length corresponding to half there of.

As will appear, the building module frame 1 has a substantially square bottom plate 3, and the building module frame 2 has a bottom plate 4 where the one lateral length corresponds to the lateral length of the bottom plate 3 whereas the other lateral length is only half that size.

Moreover, FIG. 1 illustrates a wall element 7 having at its two lateral edges a tongue 8. Since the columns 5 each have at their sides a groove 9 to match the tongue 8, however, the wall element may be mounted between the columns 5.

The wall element 7 having outer dimensions corresponding to the clearances between the columns, the wall element 7 with the tongue 8 may be inserted into the clearance between the columns 5 whereby the columns 5 may be outwardly deformed and allow that the tongue 8 engages with the corresponding grooves 9 on the columns 5 on each side of the wall element.

Figure 2:
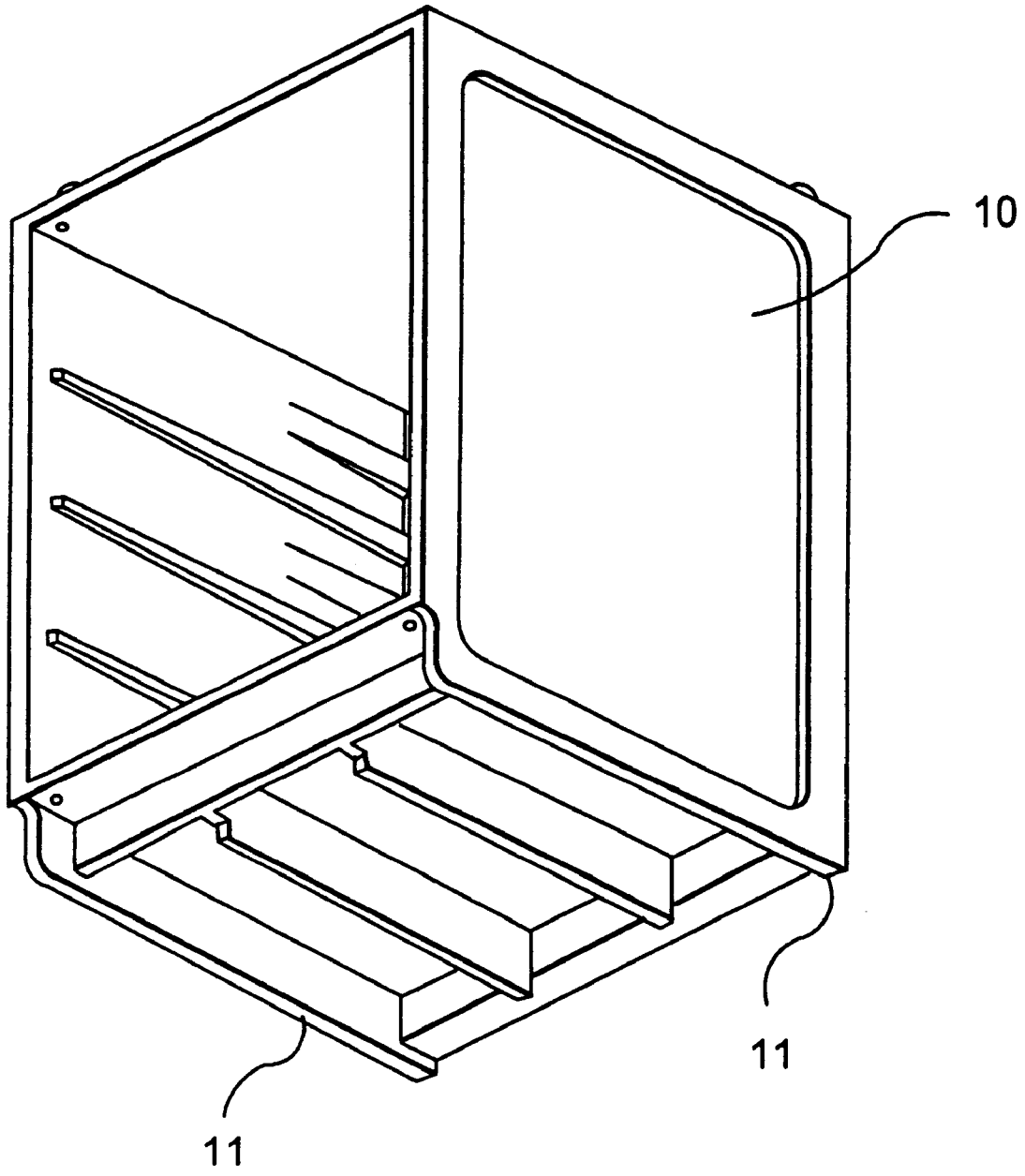
FIG. 2 is a perspective bottom plane view of a fitting according to the invention.

A more detailed perspective bottom view of a fitting 10 according to the invention is given in FIG. 2. As will appear the fitting 10 is provided with coupling flanges 11 which have a distance relative to each other to match the modular distance between the individual coupling studs 12 on the bottom plates 3,4 in the building module frames 1,2. Thus, the fitting may thus be frictionally interconnected therewith.

Figure 5:
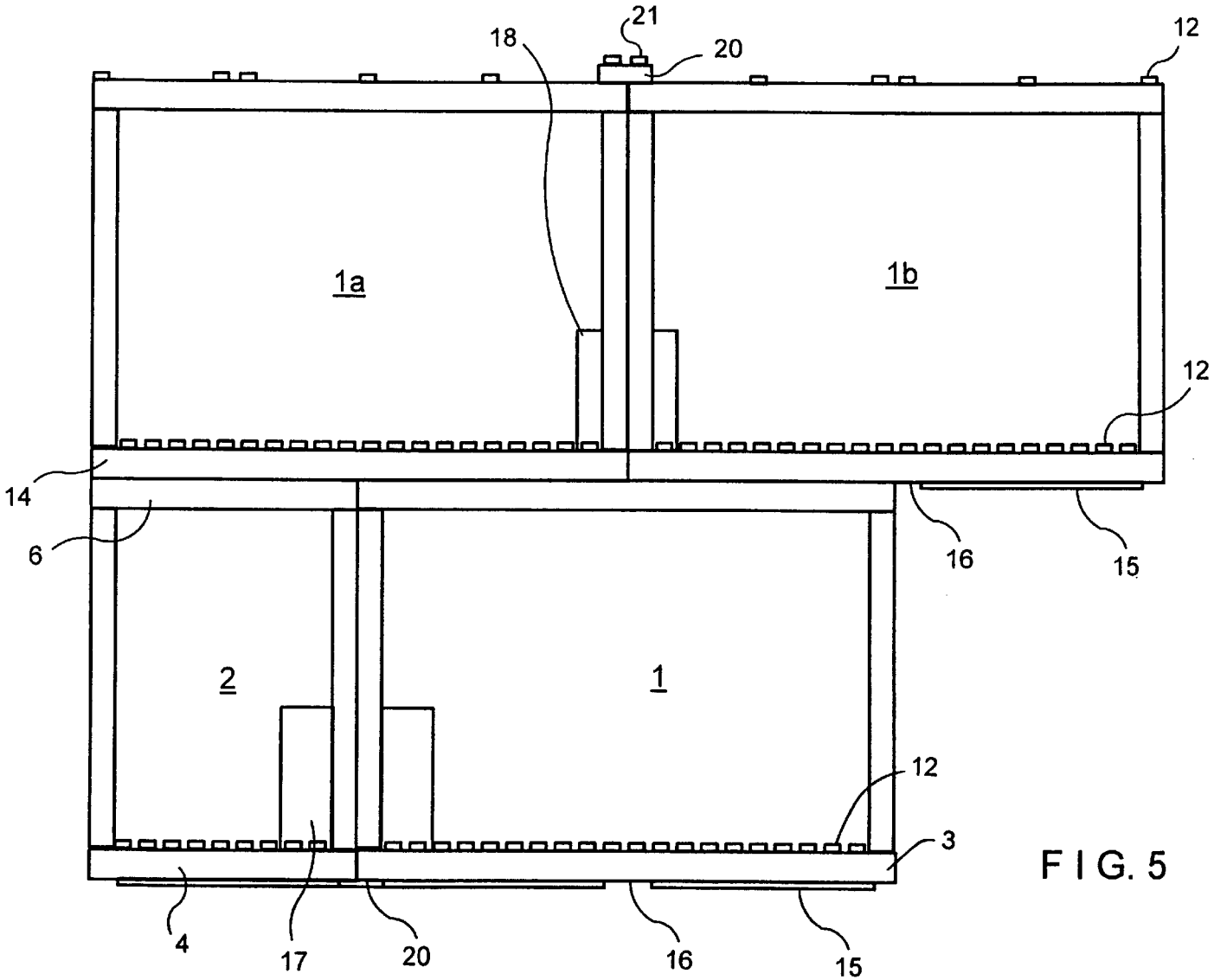
FIG. 5 is side view of a building structure composed of building module frames according to the invention.

Hereby the fitting 10 may be arranged in the building module frames 1,2 in such a manner that the one end of the fitting extends into the one building module frame 1 and the other end extends into the second module frame 2 as will appear in further detail from FIG. 5.

Thus, the fitting 10 may secure the two building module frames to each other, and in case the building module frames are lifted off the support on which they are arranged when those sides of the building module frames 1,2 that face away from each other are seized, a pressure depending on the height of the columns 5 above the bottom plate will be caused to be applied at the girders 6 of the building module frames that are pressed towards each other, as well as a pull in the fittings 10 that coupling the bottom plates 1,2 transversally of the coupling direction.

The momentum load between the fittings 10 and the bottom plates 1,2 is hereby reduced proportionally with the height of the columns 5 and replaced by a pull as described above.

It is obvious that the fittings may be in a variety of forms, such as chairs, sofas, tables and the like, without departing from the scope of the invention. Thus the fitting of may also be in the form of an interconnectable unit to be assembled from several individual components.

In this connection the building set may also comprise building blocks for the construction of walls, interiors and the like. These building blocks may thus also have coupling elements on the underside for mounting of these building blocks on the bottom plate 3,4 whereby the building blocks may also be used for interconnecting the individual building module frames 1,2.

Figure 3:
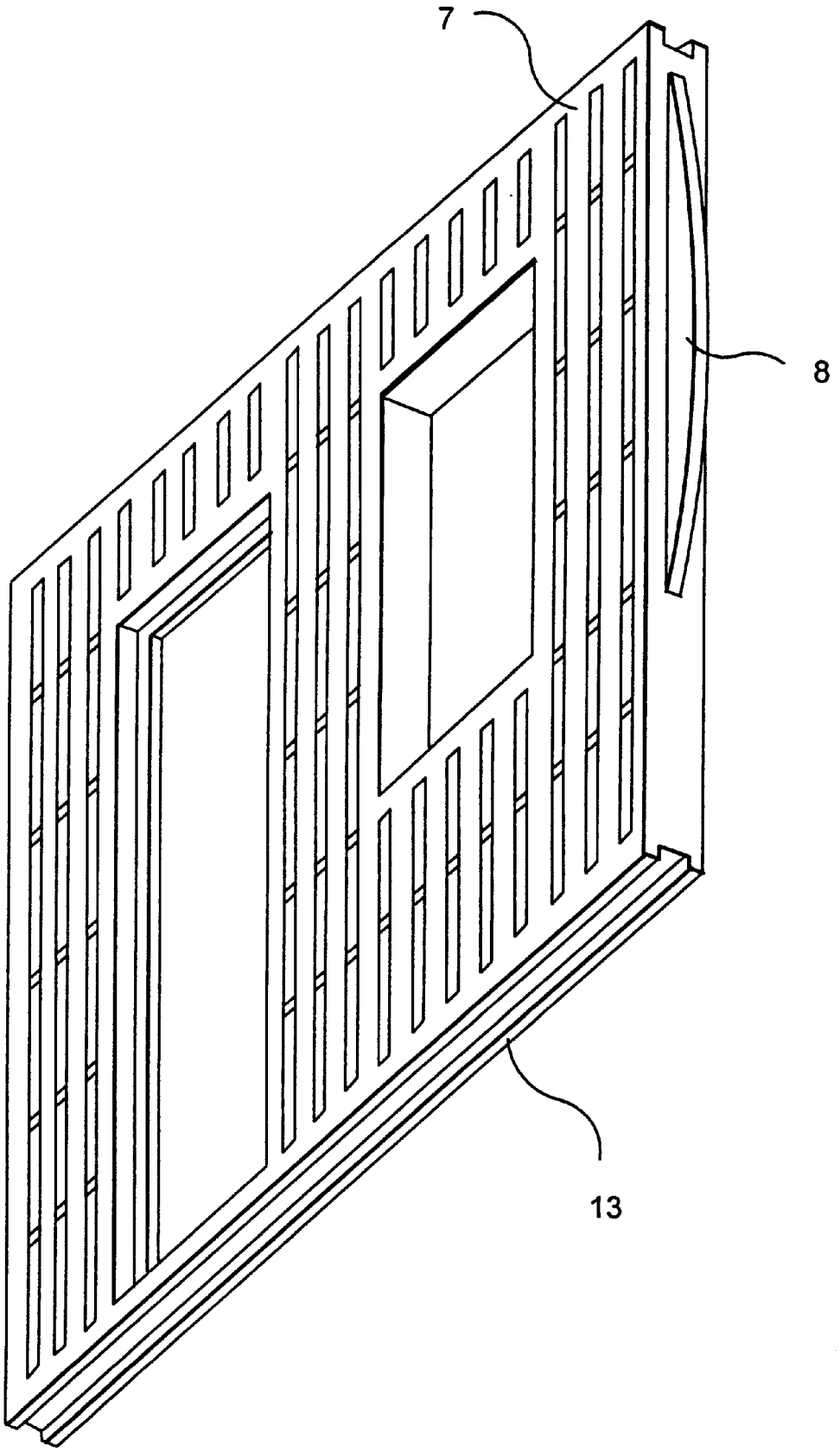
FIG. 3 is a perspective bottom plane view of a wall element.

FIG. 3 illustrates a wall element 7 which is also shown in connection with the building module frames in FIG. 1. In FIG. 3, however, the wall element 7 is shown in a perspective bottom view that illustrates how the underside of the wall element 7 is provided with coupling elements 13 for coupling the wall element 7 onto the coupling studs 12.

Hereby it is possible to arrange the wall element 7 anywhere on the bottom plates 3,4 whereby the wall elements may be used for interconnecting the building module frames 1,2, too. In addition to being suitable for interconnecting of the individual building module frames 1,2, the coupling studs 12 also have a plurality of different functions on the bottom plate; thus they may also serve to secure the position of the wall elements 7 as well as those of the fittings 10 relative to the bottom plate thereby preventing the elements 7,10 from falling out of the building module frames when moved.

The wall element 7 may also have coupling means 2 on the top surface which may engage with coupling means 23 on the underside of the bottom plates 3,4. Hereby the wall element 7 may contribute even further to the bracing of interconnected building module frames 1,1*a*,2,2*a*.

Figure 4:
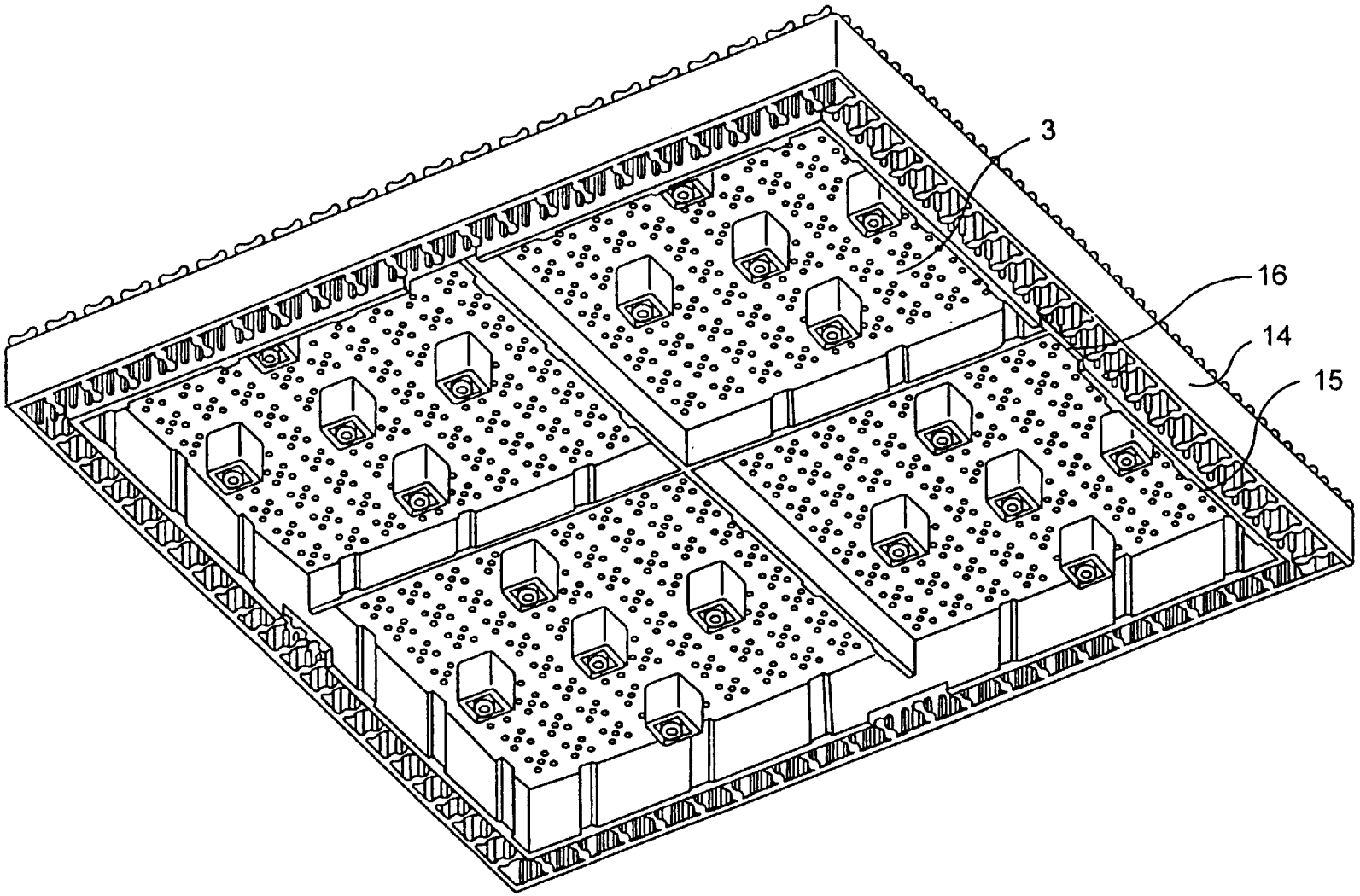
FIG. 4 is a perspective bottom plane view of a bottom plate for a building module frame according to FIG. 1.

FIG. 4 illustrates the bottom plate 3 for the building module frame 1 seen in FIG. 1 in a perspective view seen from the bottom. It will appear that the bottom plate 3 is provided with downwardly protruding outer flanges 14 which extend along the outer edge of the building plate 3. Within the outer flanges 14 and parallel therewith a further set of downwardly protruding inner flanges 15 is provided that extends a distance further downwards than the flanges 14 whereby the building plate is supported by the inner flanges 15 when arranged on a planar support thereby lifting the outer flanges 15 off the support.

Now it is possible to locate a building element 20 with coupling studs 21 below the building plate 3 without further lifting of the building plate off the support, and in such a manner that the coupling studs extend upwards between the outer flanges 14 and the inner flanges 15 and ensure frictional engagement between the building plate 3 and the building element 21. If the building element 20 extends beyond the side of the building plate as shown in FIG. 5, the building element 20 will also be interconnectable with another building plate 4 whereby the building element 20 will secure the two building elements laterally to each other.

Moreover, FIG. 4 illustrates that the inner flanges 15 do not extend continuously along the circumference of the building plate 3, but form openings 16 centrally on the elongated sides. These openings have a width corresponding to the double width of the girders 6 on the building module frames 3,4 whereby the openings 16 allow building module frames 3,4 to be arranged in a displaced manner on top of each other thereby fitting the girders 6 on the lowermost building module frames into the openings 16, and hence the openings 16 contribute to securing the lowermost building module frames at the girders 6, as will be described in further detail in connection with FIG. 5.

FIG. 5 is a sideview of a building construction composed of three square building module frames 1,1*a*,1*b* and a building module frame 2 with half the lateral length of the type shown in FIG. 1. According to the invention, the various building module frames 1,1*a*,1*b*,2 shown in FIG. 5 are interconnected in different ways, and it will appear that the lowermost building module frames 1 and 2 are interconnected at their bottom by the mounting of a fitting 17 across the bottom plates 3,4 and an element 20 extending between the undersides of the building plates 3 and 4. As will appear, the building module frames 1*a*,1*b* are interconnected at their bottom by means of the fitting 1B, and by the girders 6 (not shown in this Figure) in the lower building module frames 1,2 engaging with the openings 16 (not shown in this Figure) in the upper building module frames 1*a*,1*b*.

The bottom plate 19 on the building module frame la being provided with downwardly protruding internal flanges 15 as shown in FIG. 4 means that the building module frame 1*a* causes the lowermost building module frames 1,2 to be interconnected at the top by their girders. The upper building module frames 1*a*,1*b*, however, are interconnected at the top by a separate building element 20, corresponding to the building element 20 at the underside of the lowermost building module frames 1,2. At the top surfaces of the upper building module frames 1*a*,1*b*, the building element 20 is mounted in a manner known per se by frictionally interconnecting with the coupling studs 12 on the girders 6 of the building modules 1*a*,1*b*.

Thus the building construction according to FIG. 5 is self-supporting, but the uppermost building module frames 1*a*,1*b* may easily be carried by the lowermost building module frames 1,2 without being separated from each other, and the entire building structure may be moved as a unit without separating during moving.

As will appear, all coupling functions in the building system are effected by coupling from the top and downwards or from the bottom and upwards, and therefore these coupling functions according to the invention may be established by use of little frictional force and yet they may absorb large forces transversally to the coupling direction.

We claim:

1. A building set for a toy building comprising:

a plurality of building module frames (1, 1*a*, 1*b*, 2); and a number of fittings (10, 17, 18);

wherein the building module frames (1, 1*a*, 1*b*, 2) comprise a bottom plate (3, 4, 19) with a superstructure, the superstructure having columns extending from the bottom plate at the comers and at the periphery thereof;

and wherein the superstructure defines the walls and ceiling of the building module frame (1, 1*a*, 1*b*, 2), each bottom plate (3, 4, 19) having an outer edge being provided with top surface coupling means (12) for interconnecting adjoining building module frames (1, 1*a*, 1*b*, 2), the top surface coupling means (12) being arranged on the top surface of the bottom plate (3, 4, 19), and the top surface coupling means (12) being arranged for releasably interconnecting with complementary coupling means (11) on an underside of the fittings (10, 17, 18);

and wherein superstructure coupling means are provided for releasably securing the superstructure on the bottom plate, said superstructure coupling means having a holding force exceeding the frictional force between the bottom plate (3, 4) and the fittings (10, 17, 18).

2. A building set according to claim 1, further comprising a plurality of wall elements (7), and wherein the undersides of the wall elements (7) are provided with wall underside coupling means (13) arranged for releasable coupling with the top surface coupling means (12) on the top surface of the bottom plate (3,4).

3. A building set according to claim 2 wherein the top surface coupling means (12) on the bottom plate (3,4) comprises coupling studs that protrude from the bottom plate (3,4), and that the coupling means (11,13) on the fittings (10) and the wall elements (7) consist of recesses which may be interconnected frictionally with the coupling studs (12).

4. A building set according to claim 1, wherein the entire top surface of the bottom plate (3,4) is provided with top surface coupling means (12).

5. A building set for a toy building comprising:

a plurality of building module frames (1, 1*a*, 1*b*, 2);

a number of fittings (10, 17, 18); and flat coupling elements (20) having coupling means (21) on their one side;

wherein the building module frames (1, 1*a*, 1*b*, 2) comprise a bottom plate (3, 4, 19) with a superstructure, the superstructure having columns extending from the bottom plate at the corners and at the periphery thereof;

and wherein the superstructure defines the walls and ceiling of the building module frame (1, 1*a*, 1*b*, 2), each bottom plate (3, 4, 19) having an outer edge being provided with top surface coupling means (12) for interconnecting adjoining building module frames (1, 1*a*, 1*b*, 2), the top surface coupling means (12) being arranged on the top surface of the bottom plate (3, 4, 19), and the top surface coupling means (12) being arranged for releasably interconnecting with complementary coupling means (11) on an underside of the fittings (10, 17, 18);

and wherein at least the outer edges of the bottom plate (3, 4) are provided with complementary bottom plate coupling means (14, 15) on the underside of the bottom plate, and wherein the coupling means (21) and the bottom plate coupling means (14, 15) are so designed as to allow the elements to be connected to the bottom plate in a direction substantially perpendicular to the plane of the bottom plate (3, 4).

6. A building set according to claim 5, wherein the underside of the bottom plate (3,4) is provided with support means (15) which protrude downwardly from the underside of the bottom plate (3,4) and are arranged in such a manner that at least the bottom plate coupling means (14) along the edge of the bottom plate is lifted a distance off a support on which the bottom plate is arranged, to such height that levels with or exceeds the height of the flat coupling elements (20).

7. A building set according to claim 6, the support means (15) consists of one or more flanges which extend along the outer edge of the bottom plate (3,4) on the underside of the bottom plate.

8. A building set according to claim 7, wherein the columns of the building module support girders, and wherein the support means (15) consist of several flanges arranged consecutively to form openings (16) having a width equal to or exceeding the girders which define the ceiling of the building module frames (1, 1*a*, 1*b*, 2).

9. A building set according to claim 8, wherein the top surface coupling means (12) on the top surface of the superstructure and the bottom plate coupling means (14,15) on the underside of the bottom plate (3,4) are so arranged that the building module frames (1,1*a*,1*b*,2) may be interconnected on top of each other and displaced relative to each other.

10. A building set according to claim 5, wherein girders form a top surface on the superstructure, and wherein in a direction away from the bottom plate (3, 4), the top surface of the superstructure is further provided with the top surface coupling means (12) arranged for engagement with the bottom plate coupling means (14, 15) on the underside of the bottom plate (3, 4) with a view to interconnecting the building module frames (1, 1*a,* 1*b,* 2) on top of each other.

* * * * *